US005819497A

United States Patent [19]

Knepper

[11] Patent Number: 5,819,497

[45] Date of Patent: Oct. 13, 1998

[54] METHOD AND DEVICE FOR REPAIRING FASTENERS ATTACHED TO PLASTER BOARD

[76] Inventor: Richard T. Knepper, 8779 S. Richmond Ave., Tulsa, Okla. 74137

[21] Appl. No.: 803,266

[22] Filed: Feb. 20, 1997

[51] Int. Cl.[6] ..... E04G 23/02

[52] U.S. Cl. ..... 52/742.15; 52/514.5; 52/742.1; 52/742.16; 222/330; 222/386; 604/239

[58] Field of Search ..... 52/514, 514.5, 52/741.4, 742.1, 742.13, 742.14, 742.15, 742.16, 749.1; 222/330, 386; 604/239, 272; 606/214

[56] References Cited

U.S. PATENT DOCUMENTS

| | | | |
|---|---|---|---|
| 3,741,204 | 6/1973 | Thiele | 606/214 X |
| 4,044,512 | 8/1977 | Fischer et al. | 52/742.15 X |
| 4,062,165 | 12/1977 | Marks et al. . | |
| 4,120,128 | 10/1978 | Pauls . | |
| 4,404,054 | 9/1983 | Dickson et al. | 222/330 X |
| 4,405,308 | 9/1983 | Jessup | 604/239 X |
| 4,411,657 | 10/1983 | Galindo | 604/274 |
| 4,555,206 | 11/1985 | Sweeney . | |
| 4,607,469 | 8/1986 | Harrison | 52/514.5 X |
| 4,609,129 | 9/1986 | Fischer | 52/514.5 X |
| 4,674,257 | 6/1987 | Rose | 52/749.1 X |
| 4,693,652 | 9/1987 | Sweeney . | |
| 4,710,180 | 12/1987 | Johnson | 604/239 |
| 4,712,715 | 12/1987 | Fischer . | |
| 4,830,558 | 5/1989 | Sweeney . | |
| 4,930,281 | 6/1990 | Martin et al. . | |
| 5,033,949 | 7/1991 | Jewett . | |
| 5,155,965 | 10/1992 | Tabei et al. | 52/514.5 X |
| 5,257,486 | 11/1993 | Holmwall . | |
| 5,269,861 | 12/1993 | Gilbreath . | |

*Primary Examiner*—Carl D. Friedman
*Assistant Examiner*—Kevin D. Wilkens
*Attorney, Agent, or Firm*—Head, Johnson & Kachigian

[57] ABSTRACT

A method and device for repairing fasteners attached to plaster board, where the plaster board has become loose around the fasteners. The method is particularly useful to repair loosened threaded fasteners affixed to plaster board which have worked loose due to the brittleness and chalkiness of the plaster board. The device consists of a syringe or like implement to which is attached a specialized needle. A bonding agent is pushed by the syringe through openings in the needle and into the plaster board after the needle is inserted into the plaster board in the immediate proximity of the fasteners.

1 Claim, 2 Drawing Sheets

36
34

10
16
13
14
18
12
20
26
16
15
13
30
24
28
11
32

METHOD AND DEVICE FOR REPAIRING FASTENERS ATTACHED TO PLASTER BOARD

BACKGROUND OF THE INVENTION

1. Technical Field

This invention relates to an improved method for repairing fasteners attached to plaster board or other structural materials. Fixtures attached by fasteners to plaster board tend to loosen over time and this invention provides a method by which a specialized needle is used to inject a bonding agent into the plaster board in close proximity to the screws or other mounting means used to support the now loosened fixture, thus overcoming the looseness and restoring support strength to the fixture.

2. Background

Plaster board or dry wall is heavily favored as a wall covering for interior walls of homes and offices. The relative case of installation and its relative low cost enhances its use, particularly on inside walls of structures such as between rooms. The plaster board is applied over timbers or sometimes over metal frames which are spaced apart at certain intervals ranging from one to three feet.

In the final finishing of the building structure various fixtures are attached directly to the plaster board, as it is not always convenient to make such attachments to the underlying wall timbers which are spaced apart. Such fixtures range from towel and tissue racks in bathrooms to curtain supports over windows and other like devices. A well known method for affixing such fixtures to the plaster board walls is to use threaded fasteners such as screws. Many individuals will attach various fixtures by using standard wood screws or machine screws. If the fixture is subjected to stress at the junction between the threaded fastener and the plaster board, such as is common for towel racks, curtain rod supports and the like, the brittle, chalky nature of the plaster board will cause a loosening of the plaster board in and about the mounting screw thread, with a resultant loosening of the fixture. This loosening is particularly pronounced when installations are done with a minimum of care. There exist specially designed screws for use with plaster board, however, these special screws may also work loose over time.

This invention provides a means to overcome such fastening deficiencies and to repair such loose fastenings in an expeditious manner. The invention is particularly useful to repair plaster board covered with decorative wall paper, as the repair is made without the need to repaper the surface with new decorative wall paper.

Existing repair methods include removing the fixture and fasteners from their original location and reaffixing the fixture to an undamaged section of wall. This process requires the repainting or repapering of the old location. Existing patents describe means or tools to inject a bonding compound into cracks in concrete such as Holmwell, U.S. Pat. No. 5,257,486 and Tabei et al, U.S. Pat. No. 5,155,965. Another inventor describes a means for inserting a fixing agent to better anchor a fastener to be installed in masonry, U.S. Pat. No. 4,712,715 to Fischer, and another discusses a method for installing an anchoring member, U.S. Pat. No. 4,120,128 to Pauls. None of these patents, however, addresses the problem overcome by this invention which is the repair of loosened fasteners attached to plaster board. This invention provides a method for repairing and refastening loosened fasteners by inserting a bonding agent at the loosened point even when there is no surface crack or other surface opening or damage.

SUMMARY OF THE INVENTION

The repair method consists of using a special needle through which a bonding agent may be injected directly into the area between the mounting screw and the plaster board. The bonding agent fills the interstices between cracks or fissures in the plaster board and the fastener, and is allowed to harden, thus stabilizing the fastener and preventing further loosening of the fastener from the plaster board wall. The fastener is then well suited to securely hold the fixture, such as a towel rack or hook, in place.

The needle utilized is specially designed to be thin and thus can penetrate the plaster board by manual insertion without the need for power tools. The point is sharp and solid, with holes or openings on the sides of the needle. The needle is connected to a container in which the bonding agent may be stored and a compression device by means of which the liquid bonding agent may be pushed from the storage reservoir through the needle openings into the plaster board at the fastener point. A readily available syringe may be used. To ensure proper fixation, the needle may be inserted at more than one point about the fastener's periphery.

A better understanding of the invention and its objects and advantages will become apparent to those skilled in this art from the following detailed description, taken in conjunction with the attached drawings, wherein there is shown and described only the preferred embodiment of the invention, simply by way of illustration of the best mode contemplated for carrying out the invention. As will be realized, the invention is capable of modifications in various obvious respects, all without departing from the invention. Accordingly, the description should be regarded as illustrative in nature and not as restrictive.

DETAILED DESCRIPTION OF THE PREFERRED EMBODIMENT

Figures 1, 2:
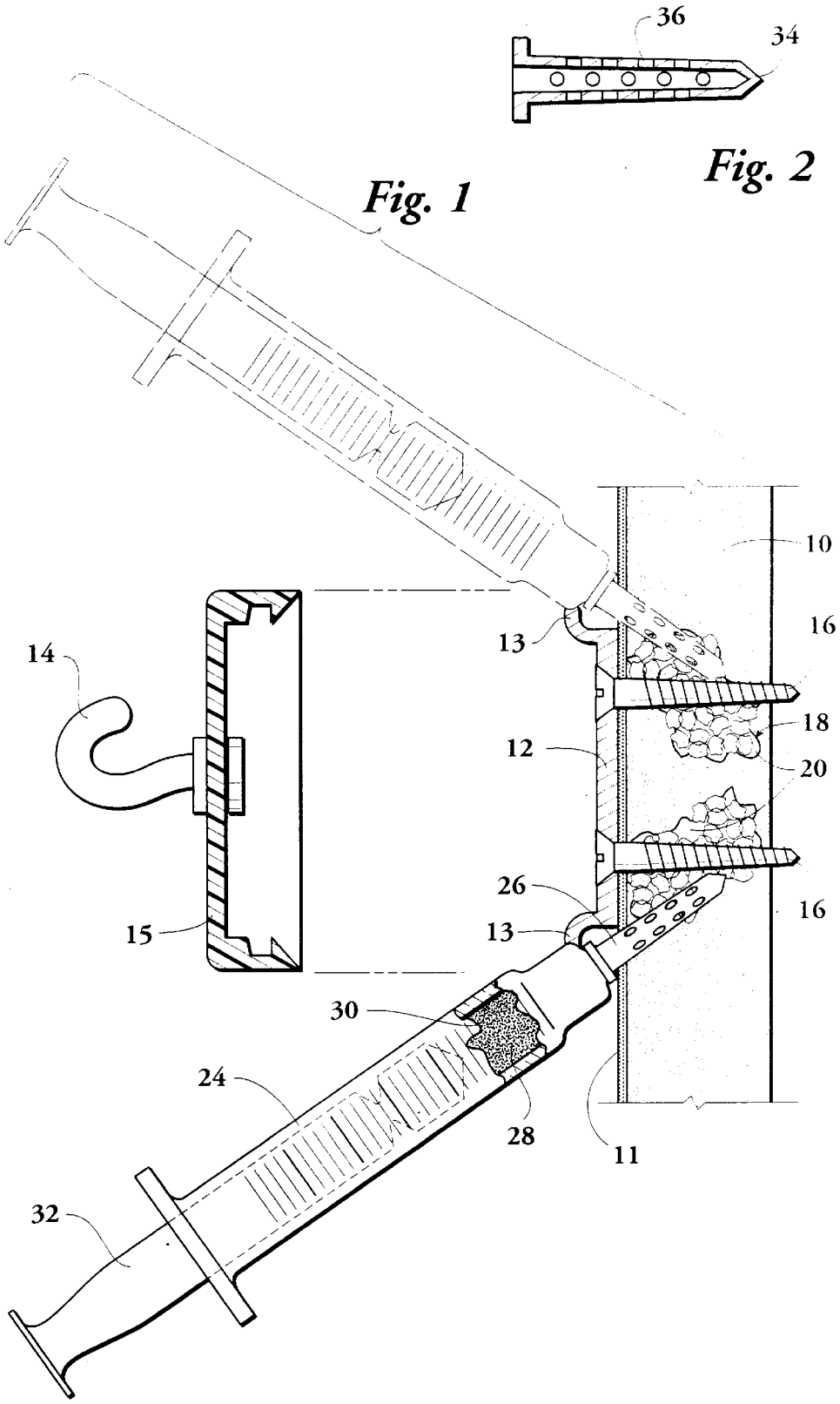
FIG. 1 shows a cross-sectional view of the bonding agent being applied with the specialized needle to a loose fastener in plaster board.
FIG. 2 shows the detail of the openings in the needle tip through which the bonding agent is forced into the plaster board.

The drawings illustrate both the problem the invention seeks to overcome and the solution. FIGS. 1 and 3–5 show a section of plaster board wall 10. The outer surface of the plaster board wall 10 is covered with a wall covering 11 such as wallpaper. A typical mounting plate 12 is shown secured to the plaster board wall 10. The mounting plate 12 has opposed flanges 13 for securely receiving a fixture bracket 15. In this case, the fixture bracket 15 is shown to support a hook 14 for holding a towel, robe or other article. The mounting plate 12 is fastened directly to the plaster board wall 10 with a number of threaded flat-head screws 16, which are tightened flush against the mounting plate 12.

Figure 4:
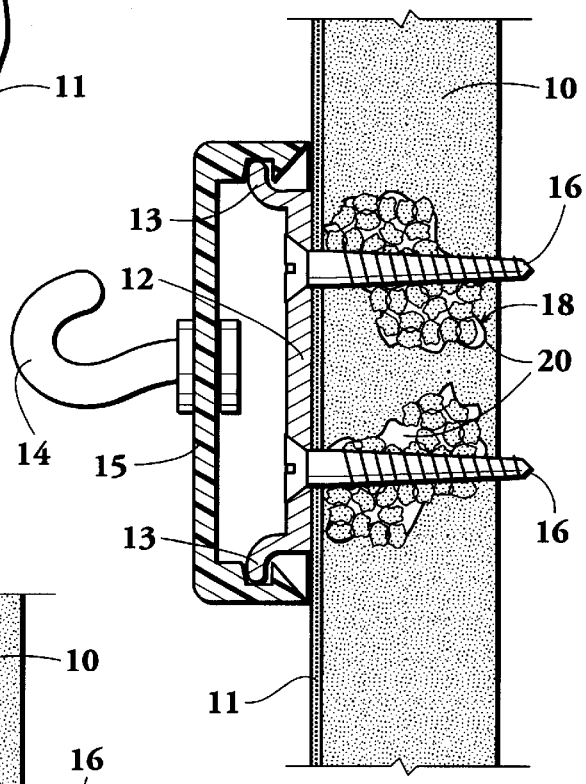
FIG. 4 is a cross-sectional side view of the loosened plaster board around threaded fasteners holding a hook fixture to a plaster board wall.

FIGS. 1 and 4 show in cross section a loosened area 18 surrounding the screws 16. These loosened areas 18 cause the mounting plate 12 and its associated fixture, such as hook 14, to become unstable. Several spaces or interstices 20 are evident in the loosened areas 18 and a number of cracks or fractures 22 can be seen surrounding the mounting plate 12.

As shown in FIG. 1, the fixture bracket 15 is removed and a bonding agent is injected around the periphery of the mounting plate 12 into the plaster board wall 10 by means of a syringe 24, which syringe 24 is equipped with a specialized needle 26. Readily available syringes may be used if they are fitted with the specialized needle 26 as further described. The bonding agent 28 is loaded into the syringe reservoir 30, and after the needle 26 is inserted into the plaster board wall 10 the bonding agent 28 is forced out of the syringe reservoir 30 and into the plaster board wall 10 by the plunger 32.

The specialized needle 26 consists of a thin hollow cylinder with an occluded tip 34 and contains a plurality of openings 36 along its length and periphery as outlined in the cross-section of such needle shown in FIG. 2. The end opposite the occluded tip 34 is attached to the syringe 24 and allows the bonding agent 28 to pass from the syringe reservoir 30 into the needle 26. Although the needle tip 34 shown is a pointed conical tip, an inclined flattened tip may also be used. The needle should be a fairly thin needle in order to be readily insertable into the plaster board. As shown in FIG. 1, the needle 26 is inserted through the wall covering 11 and outer surface of the plaster board wall 10 into the loosened areas 18 and the bonding agent 28 is forced in. Small amounts of bonding agent usually suffice to cure the looseness; such amounts are typically less than 4 cc. When necessary, the needle 26 may be inserted at more than one point around the fastener's periphery to ensure bonding agent penetration. An occluded tip 34 is recommended to ease penetration of the needle 26 into the plaster board wall 10 and to prevent plaster from blocking the needle passageway. It also allows for better distribution of the bonding agent 28 which otherwise might be injected through the opposite side of the plaster board.

Figure 3:
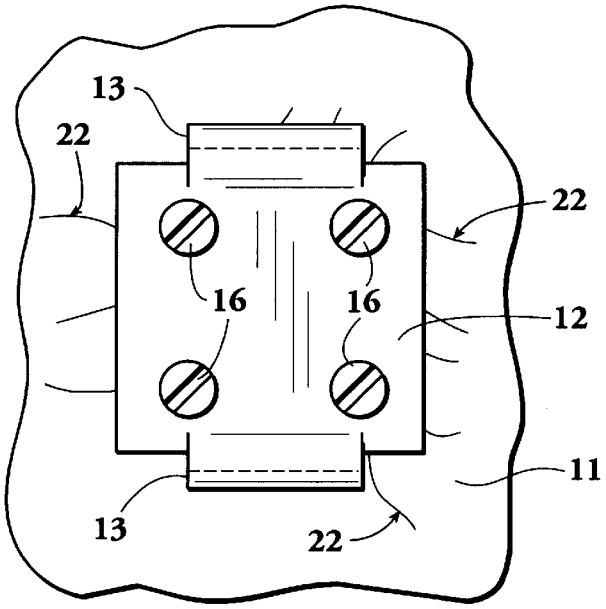
FIG. 3 is a front view of a hook fixture mounted to a plaster board wall by threaded fasteners.
Figure 5:
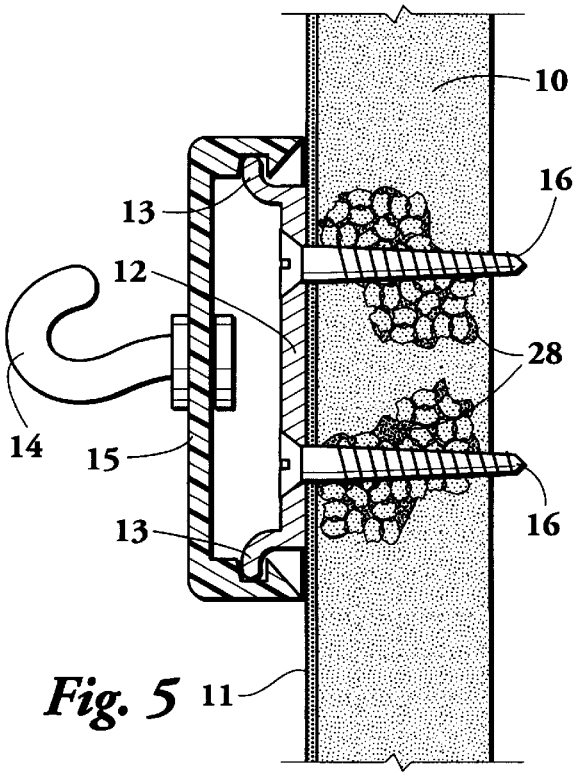
FIG. 5 is a cross-sectional side view of the plaster board around threaded fasteners holding a hook fixture to a plaster board wall, after the same has been treated by inserting a bonding agent therein.

FIG. 3 shows a typical hook fixture 14 mounted to the plaster board wall 10 by means of a mounting plate 12 and four threaded screws 16. Fractures or cracks are visible around the periphery of the mounting plate 12 indicating a weakened mount. FIG. 4 shows such a fixture where there are two loosened areas 18 around the threaded screws 16. In such a circumstance, the fixture 14 is too loose and wobbly for use. If used, the fixture 14 might pull away from, or pull completely out of, the plaster board wall 10. FIG. 5 shows the result after injection of the bonding agent 28 whereby the fasteners 16 are solidly attached to the plaster board wall 10 again. In a ceramic style hook fixture, the outside ceramic fixture is slipped over a metal mounting which is the part attached to the plaster board.

This repair method allows for repair without the removal and relocation of the underlying metal support fixture or mounting plate.

Many different bonding agents may be used with the new method and specialized needle. The inventor has found that LOCTITE WELDBOND® bonding agent diluted to three parts water and one part bonding agent works well. After insertion into the plaster board wall at the fastener area, the bonding agent should be allowed sufficient time to set up.

This method of repairing loosened fixtures mounted on plaster board is particularly effective where the fixture is mounted to plaster board wall covered by decorative wall coverings. Another advantage of the invention is that the repair may be done without moving the fixture to a new location with resultant need to repair the wall covering and in fact can be done with a minimum of unsightly repair damage. Typically the small pin prick made by the insertion of the specialized needle will not be visible to the casual observer, as the fixture bracket 15 will hide the penetration points. If desired, the wall covering near the fixture fastener to be repaired may be partially removed to allow insertion of bonding agent by means of the specialized needle without actually penetrating through the decorative wall covering.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of repairing a loosened fastener installed in a plaster board wall or other surface wherein said fastener is used to hold a fixture to said plaster board wall and wherein a loosened area has developed around said fastener, said method comprising injecting a bonding solution into said loosened area without removing said fastener by use of an injection device having a needle at one end, said needle having a plurality of openings through which said bonding agent is forced into said loosened area, said bonding agent then bonding said loosened fastener to said plaster board wall such that said fastener is solidly affixed to said plaster board wall.

* * * * *